US007910273B2

(12) United States Patent
Nakamura et al.

(10) Patent No.: US 7,910,273 B2
(45) Date of Patent: Mar. 22, 2011

(54) IMAGE FORMING METHOD

(75) Inventors: Masahiko Nakamura, Hachioji (JP); Masahiro Anno, Hachioji (JP); Kaori Soeda, Hino (JP); Tomoko Mine, Hino (JP); Kenichi Onaka, Hachioji (JP); Eiichi Yoshida, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 948 days.

(21) Appl. No.: 11/746,304

(22) Filed: May 9, 2007

(65) Prior Publication Data

US 2007/0298338 A1 Dec. 27, 2007

(30) Foreign Application Priority Data

Jun. 21, 2006 (JP) ..... 2006-171145

(51) Int. Cl.
*G03G 5/00* (2006.01)

(52) U.S. Cl. ..... 430/48; 430/109.3; 430/123.5; 399/252

(58) Field of Classification Search ..... 430/48, 430/109.3, 123.5; 399/252
See application file for complete search history.

(56) References Cited

U.S. PATENT DOCUMENTS

| | | | | |
|---|---|---|---|---|
| 6,316,157 | B1 * | 11/2001 | Yoshikawa et al. | 430/108.3 |
| 2002/0086228 | A1 | 7/2002 | Koumura | |
| 2003/0211414 | A1 | 11/2003 | Kohtaki | |
| 2006/0046175 | A1 | 3/2006 | Yoshida | |

FOREIGN PATENT DOCUMENTS

| | | |
|---|---|---|
| EP | 1388762 | 2/2004 |
| JP | 02001869 | 1/1990 |
| JP | 07036213 | 2/1995 |

* cited by examiner

*Primary Examiner* — Mark A Chapman
(74) *Attorney, Agent, or Firm* — Lucas & Mercanti, LLP

(57) ABSTRACT

An electrophotographic image forming method is disclosed. In the method electrostatic latent image is developed by a non-magnetic single-component developing system, in which a non-magnetic single-component developer is conveyed by a developer carrying member, the developer carrying member is contacted with a developer layer regulation member for regulating an amount of the developer at the surface of the developer carrying member, and a binder resin of the developer comprises a vinyl polymer having an acid value of from about 5 to about 30 mgKOH/g and a ratio of hydroxyl group value/acid values from about 0.3 to about 0.8.

16 Claims, 1 Drawing Sheet

IMAGE FORMING METHOD

This application is based on Japanese Patent Application No. 2006-171145 filed on Jun. 21, 2006, in Japanese Patent Office, the entire content of which is hereby incorporated by reference.

FIELD OF THE INVENTION

The present invention relates to an electrophotographic image forming method using a non-magnetic single-component developing system.

TECHNICAL BACKGROUND

As the non-magnetic single-component developing system, for example, methods described in Japanese Patent Laid Open to Public Publication (JP-A) Nos. 63-212946, 63-271374 and Japanese Patent Examined Publication (JP-B) No. 2774534 have been known. In this system, an electrostatic latent image is developed by supplying a thin layer of a non-magnetic developer onto the surface of a electrostatic latent image forming member by a developing apparatus having a developer carrying member, a toner layer regulation member and a toner supply assisting member in which the toner supply assisting member and the developer carrying member, and toner layer regulation member and the developer carrying member are respectively contacted with together to form the developer thin layer. In such the method, the non-magnetic toner is charged by friction electrification of the non-magnetic developer with developer carrying member and the toner layer regulation member.

Color electrophotographic apparatuses have a merit such as that the developing apparatus can be made compact and are widely utilized at desk side of offices, in small offices, SOHO and domestic houses. In the non-magnetic single-component developing system, the toner particles are electrically charged by passing through the gap between the developer carrying member and the toner layer regulation member arranged to be contacted with the toner layer regulation member. The toner particles receive stress on the occasion of passing through the gap between the developer carrying member and the toner regulation member. The mechanical strength of the toner particles is held by raising the softening point thereof by controlling the molecular weight thereof or giving crosslinked structure so as to prevent the crushing of the toner particles by the stress. As a result of that, the fixing temperature is raised and electric consumption is increased so that the load onto the use in the small offices, SOHO and domestic house is increased. Under such the conditions, a technique for dispersing organic polymer fine particles having high softening point and a particle diameter of not more than 0.5 μm, cf. Patent Document 1 for example, and that by which filler particles are dispersed in a thermoplastic layer covering the nucleus particles mainly composed of thermoplastic resin and colorant, cf. Patent Document 2 for example, have been known. However, such the toner particles do not satisfy the fixing ability at low temperature and anti-crushing ability.

Patent Document 1: JP-A 2-1869

Patent Document 2: JP-A 7-36213

SUMMARY

An object of the invention is to provide an image forming method using non-magnetic single-component developing system by which an image having low temperature fixing ability and high quality image can be stably obtained.

Embodiments of this invention are described.

1. An image forming method by which an electrostatic latent image formed on a electrostatic latent image carrying member is developed by a non-magnetic single-component developing system by a developer conveyed by a developer carrying member contacted with a developer layer regulation member for regulating the amount of the developer at the surface of the developer carrying member, wherein binder resin of the developer is vinyl type polymer having an acid value of from 5 to 30 mgKOH/g and a ratio of hydroxyl group value/acid value is from 0.3 to 0.8.

2. The image forming method of the above item 1, wherein the developer is formed by coagulating the resin and a colorant in an aqueous medium.

Figure 1:
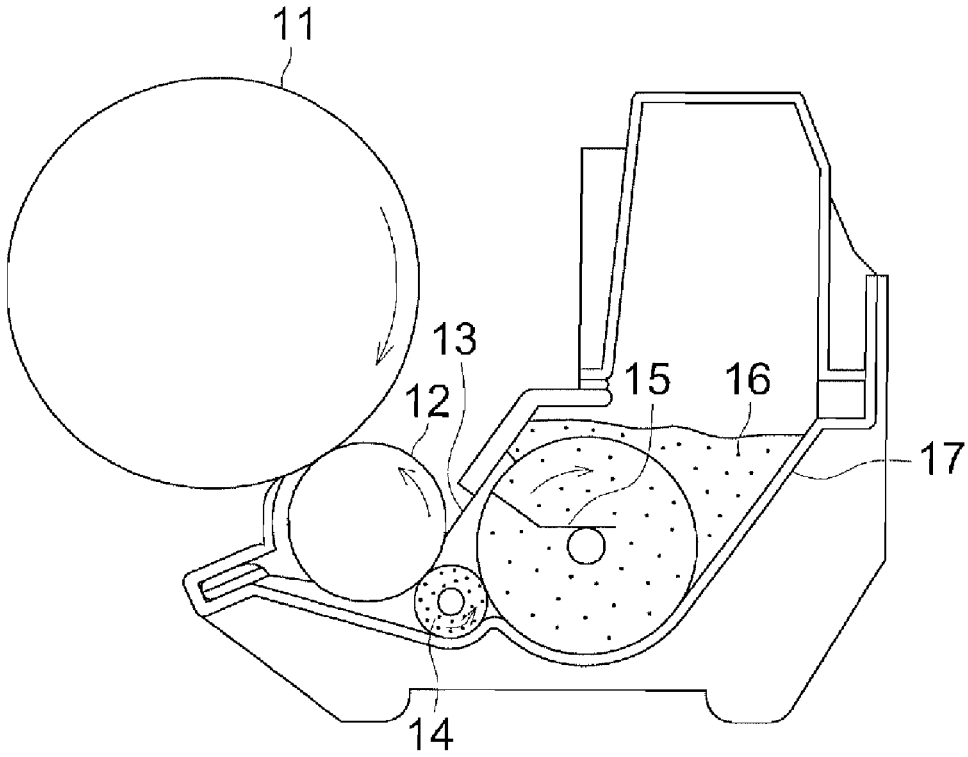
FIG. 1 shows a schematic cross section of an example of developing apparatus to be used in the image forming method of the invention.

The image forming method using the non-magnetic single-component developing system can be provided by the invention, by which an image having low temperature fixing ability and high quality image can be stably obtained.

DETAILED DESCRIPTION OF THE PREFERRED EMBODIMENTS

In the image forming method of the invention, an electrostatic latent image formed on the electrostatic latent image carrying member is developed by the non-magnetic single-component developing system. In this system a non-magnetic single-component developer is conveyed by a developer carrying member, and the developer carrying member is contacted with a developer layer regulation member for regulating an amount of the developer at the surface of the developer carrying member, and a binder resin of the developer is vinyl type polymer having an acid value of from 5 to 30 mgKOH/g and a ratio of hydroxyl group value/acid value is from 0.3 to 0.8. The hydroxyl group value is preferably from 1.5 to 24.

The binder resin is composed of vinyl based polymer and does not include a polyester based polymer. The developer having sufficient mechanical strength even though the softening point thereof is lower than usual developers can be obtained by controlling the hydroxyl group value and acid value of the vinyl based polymer used as the binder resin.

In the invention, the developer is a colored particle comprising the resin and the colorant which are externally treated by an additive such as hydrophobic silica.

In concrete, the softening point of the developer can be lowered while holding the mechanical strength thereof at room temperature by utilizing the hydrogen bond between the hydroxyl group and the acidic group. The hydrogen bond physically links the acidic group and the hydroxyl group of molecular chains at room temperature so as to raise the mechanical strength at room temperature. The kinks are easily broken when the resin is heated. The toner can be fixed at a temperature lower than that in the usual method while maintaining the mechanical strength by positively introducing the hydrogen bonds to the side chain of the vinyl type polymer resin. The vinyl type polymer resin comprises hydroxyl groups and acid groups in side chain of the polymer.

When the acid value is less than 5, formation of the hydrogen bonds is insufficient and contribution on the mechanical strength is small and when the acid value exceeds 30 mgKOH/g, the moisture amount absorbed by the developer is increased and sufficient charge cannot be obtained so as to cause image defects such as fogging and transfer lacking. In the case of that the ratio of hydroxyl group value/acid value is less than 0.3, the hydrogen bonds are insufficiently formed and contribution on the mechanical strength is small. When the ratio of hydroxyl group value/acid value in the binder resin exceeds 0.8, the acid groups having negative polarity are shortened and sufficient negative chargeability cannot be obtained.

The acid value and the ratio of hydroxyl group value/acid value can be controlled by controlling the using amount of an acidic monomer, a monomer having hydroxyl group and a polymerization initiator having a hydroxyl group. The acid value is determined according to the acid value testing method of JIS K0070. As the solvent, a mixture of tetrahydrofuran and isopropyl alcohol in a volume ratio of 1:1 is used and the acid value is measured by a potentiometric titration method. The hydroxyl group value is determined by a potentiometric titration method according to the hydroxyl group value testing method of JIS K0070.

The colored particle according to the invention can be produced by a suspension polymerization or an emulsion polymerization method in which a monomer is emulsion polymerized in a liquid containing an emulsion of necessary additive to form fine polymerized particles and then the particles are associated by adding an organic solvent or an aggregation agent. A method in which a dispersion of a component necessary for constituting the colored particle such as a parting agent and a colorant is mixed with the above emulsified polymer particles on the occasion of the association of the particles and a method in which the color particle constituting component such as the parting agent and the colorant is dispersed in the monomer and then polymerized are applicable. The association is defined as fusion of several numbers of resin particle and the colorant particles.

In the invention, the aqueous medium is a medium containing at least 50% by weight of water.

The constituting materials such as the parting agent, a charge controlling agent and the polymerization initiator are added into the polymerizable monomer and dissolved or dispersed them by a dispersing means such as a homogenizer, a sand mill, a sand grinder and a ultrasonic dispersing machine. The polymerizable monomer in which the constitution materials are dissolved or dispersed is dispersed into the form of oil droplet each having a sized desired for the colored particle in the aqueous medium containing a dispersion stabilizer by a homo-mixer or a homogenizer. After that, the resultant dispersion is transferred into a reacting vessel having a stirring mechanism having the later-mentioned stirring wing and heated for accelerating the polymerization reaction. After the completion of the reaction, the dispersion stabilizer is removed and the polymerized particles are filtered, washed and dried to prepare the colored particles of the invention.

Example of a method to produce the toner of the present invention includes a method in which resin particles are prepared upon associating or fusing with each other in an aqueous medium. This method is not particularly limited, and other methods may be listed which are disclosed in, for example, Japanese Patent Publication Open to Public Inspection Nos. 5-265252, 6-329947, and 9-15904.

The toner of the present invention is prepared employing a method in which a plurality of dispersion particles of the constitution materials comprised of resin particles, colorants and the like, or of fine particles comprised of resins, colorants, and the like, are associated, in which in particular, after dispersing these into water employing an emulsifier, the resulting dispersion is salted out by adding a coagulant in an amount of more than the critical coagulation concentration; at the same time, while forming fused particles upon heating the formed polymer at least to the glass transition temperature of the polymer, so as to fuse with each other, the particle diameter is increased; when growing the particle diameter to a desired diameter, a large amount of water is added to halt the growth of the diameter; the particle surface is then smoothed through heating and stirring, whereby the shape is controlled; and the resulting particles are heat dried in a fluid state while suspended in a water comprising state. Further, herein, organic solvents which are infinitely soluble in water may be added at the same time, together with a coagulating agent.

Employed polymerizable monomers to constitute a resin include styrenes or styrene derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, dimethylaminoethyl methacrylate, and the like; acrylic acid ester derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, vinylidene fluoride, and the like; vinyl esters such as vinyl propionate, vinyl acetate, vinyl benzoate, and the like; vinyl ethers such as vinyl methyl ether, vinyl ethyl ether, and the like; vinyl ketones such as vinyl methyl ketone, vinyl ethyl ketone, vinyl hexyl ketone, and the like; N-vinyl compounds such as N-vinylcarbazole, N-vinylindole, N-vinylpyrrolidone, and the like; vinyl compounds such as vinylnaphthalene, vinylpyridine, and the like; acrylic acid or methacrylic acid derivatives such as acrylonitrile, methacrylonitrile, acrylamide and the like. These vinyl based monomers may be employed individually or in combination.

An acid monomer is used as polymerizable monomers, which constitute a resin in combination with the afore-mentioned polymerizable monomer. The example include those having a substituent such as a carboxyl group, a sulfonic acid group, a phosphoric acid group, and the like in the acid monomer. Listed as specific examples are acrylic acid, methacrylic acid, maleic acid, itaconic acid, cinnamic acid, fumaric acid, monoalkyl maleate, monoalkyl itaconate, styrenesulfonic acid, allylsulfosuccinic acid, 2-acrylamide-2-methylpropanesulfonic acid, acidphosphoxyethyl methacrylate, 3-chloro-2-acidphophoxypropyl methacrylate, and the like.

For the purpose of introducing a hydroxyl group, polymerizable monomers including various hydroxyalkyl (meth) acrylates such as such as 2-hydroxyethyl (meth)acrylate, 2-hydroxypropyl (meth)acrylate, 2-hydroxybutyl (meth) acrylate, and 4-hydroxybutyl (meth)acrylate, or various vinyl ethers such as 2-hydroxyethylvinylether, 4-hydroxybutylvinylether and 6-hydroxyhexyl vinylether Polymerization initiator including hydrogen peroxide or an organic peroxide having a hydroxyl group in a molecule, may be employed for the same purpose, if necessary.

Further, the resin may be modified so as to have a cross-linking structure, employing multifunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, and the like.

These polymerizable monomers may undergo polymerization employing a radical polymerization initiator. In such cases, oil-soluble polymerization initiators may be employed in a suspension polymerization method. Such oil-soluble polymerization initiators include azo based or diazo based polymerization initiators such as 2,2'-azobis-(2,4-dimethylvaleronitrile, 2,2'-azobisisobutyronitrile, 1,1'-azobis(cyclohexane-1-carbonitrile), 2,2-azobis-4-methoxy-2,4-dimethylvaleronitrile, azobisisobutyronitrile, and the like; and peroxide based polymerization initiators and polymer initiators having a peroxide in the side chain such as benzoyl peroxide, methyl ethyl ketone peroxide, di-isopropylperoxycarbonate, cumenehydroperoxide, t-butylhydroperoxide, di-t-butylperoxide, dicumylperoxide, 2,4-dichlorobenzoyloxide, lauroylperoxide, 2,2-bis-(4,4-t-butylperoxycyclohexyl) propane, tris-(t-butylperoxy)triazine, and the like.

Further, when the emulsion polymerization method is employed, water-soluble radical polymerization initiators may be employed. Water-soluble polymerization initiators include persulfates such as potassium persulfate, ammonium persulfate, and the like, azobisaminodipropane acetic acid salts, azobiscyanovaleric acid and salts thereof, hydrogen peroxide, and the like.

Listed as dispersion stabilizers may be tricalcium phosphate, magnesium phosphate, zinc phosphate, aluminum phosphate, calcium carbonate, magnesium sulfate, calcium hydroxide, magnesium hydroxide, aluminum hydroxide, calcium metasilicate, calcium sulfate, barium sulfate, bentonite, silica, alumina, and the like. Further, also employed as dispersion stabilizers may be those which are generally employed as surface active agents such as polyvinyl alcohol, gelatin, methyl cellulose, sodium dodecybenzenesulfonate, ethylene oxide additives, higher alcohol sodium sulfate, and the like.

Preferred as the binder resins are those having a glass transition point of 20 to 90° C., as well as a softening point of 80 to 220° C. The glass transition point is a value measured by a differential calorimetric method, while the softening point can be measured by an elevated type flow tester. Further, these resins preferably have a number average molecular weight (Mn) of 1,000 to 100,000, as well as a weight average molecular weight (Mw) of 2,000 to 1,000,000, which are measured by gel permeation chromatography. Further, as a molecular weight distribution, the Mw/Mn is preferably between 1.5 and 100, and is most preferably between 1.8 and 70.

The employed coagulating agents are not particularly limited, however those selected from metal salts are more suitable. Specific examples include salts of univalent metals such as alkali metals, for example, sodium, potassium, lithium and the like; alkali earth metal salts of divalent metals such as calcium, magnesium, and the like; salts of divalent metals such as manganese, copper, and the like; and salts of trivalent metals such as iron, aluminum, and the like. Listed as specific salts can be sodium chloride, potassium chloride, lithium chloride, calcium chloride, zinc chloride, copper sulfate, magnesium sulfate, manganese sulfate, and the like. These may be employed in combination.

These coagulants are preferably added in an amount exceeding the critical coagulation concentration. The critical coagulation concentration as described herein is an index on the stability of an aqueous dispersion, and concentration at which coagulation is formed by the addition of a coagulant. The critical coagulation concentration varies greatly depending on the emulsified components and dispersing agents themselves. For example, the critical coagulation concentration is described in Seize Okamura, et al. "Kobunshi Kagaku (Polymer Chemistry)", edited by Nihon Kobunshi Gakkai, whereby detailed critical coagulation concentration data can be obtained. Furthermore, as another method, zeta (zeta) potentials of a specified particle dispersion are measured upon adding a desired salt to the particle dispersion, while changing the salt concentration, and said salt concentration which varies the zeta potential can be obtained as the critical coagulation concentration.

The added amount of the coagulant of the present invention is acceptable if it exceeds the critical coagulation concentration. However, the addition amount is preferably at least 1.2 times of the critical coagulation concentration, and is more preferably at least 1.5 times.

A solvent which is infinitely soluble denotes a solvent which is infinitely soluble in water and as such solvents, those which do not dissolve the resin formed in the present invention are selected. Specifically, cited are alcohols such as methanol, ethanol, propanol, isopropanol, t-butanol, methoxyethanol, butoxyethanol, and the like, nitrites such as acetonitrile, and ethers such as dioxane. In particular, ethanol, propanol and isopropanol are preferred.

The added amount of such solvents which are infinitely soluble is preferably between 1 and 100 percent by volume of the polymer containing dispersion to which the coagulant is added.

Further, in order to make all particles of a uniform shape, after preparing colored particles and filtering them, the resulting slurry, in which water is present in an amount of at least 10 percent by weight of the particles, is preferably subjected to fluidized drying. At the time, those which comprise a polar group in the polymer are particularly preferred. As the reason, it is assumed that since existing water somewhat exhibits swelling effect for the polymer comprising the polar group, making particles of a uniform shape tends to be particularly easily carried out.

The toner of the present invention comprises at least a resin and a colorant, but may as well comprise a releasing agent which works as a fixing property improving agent, a charge control agent, and the like. Further, external additives comprised of fine inorganic particles, fine organic particles, and the like may be added to toner particles which are mainly comprised of the above-mentioned resin and colorant.

Optionally employed as colorants in the invention, which are employed in the toner of the present invention, may be carbon blacks, magnetic materials, dyes, pigments, and the like. Employed as said carbon blacks are channel black, furnace black, acetylene black, thermal black, lamp black, and the like. Employed as magnetic materials may be ferromagnetic metals such as iron, nickel, cobalt, and the like, as well as alloys which do not comprise ferromagnetic metals and are subjected to thermal treatment to exhibit ferromagnetism, such types of alloys being called Heusler's alloys, being for example, manganese-copper-aluminum, manganese-copper-tin and the like, and also chromium dioxide, and the like.

Employed as dyes can be C.I. Solvent Red 1, Solvent Red 49, Solvent Red 52, Solvent Red 58, Solvent Red 63, Solvent Red 111, and Solvent Red 122, C.I. Solvent Yellow 19, Solvent Yellow 44, Solvent Yellow 77, Solvent Yellow 79, Solvent Yellow 81, Solvent Yellow 82, Solvent Yellow 93, Solvent Yellow 98, Solvent Yellow 103, Solvent Yellow 104, Solvent Yellow 112, and Solvent Yellow 162; C.I. Solvent Blue 25, Solvent Blue 36, Solvent Blue 60, Solvent Blue 70, Solvent Blue 93, and Solvent Blue 95, and the like. Furthermore, these mixtures may be employed. Employed as pigments may be C.I. Pigment Red 5, Pigment Red 48:1, Pigment Red 53:1, Pigment Red 57:1, Pigment Red 122, Pigment Red 139, Pigment Red 144, Pigment Red 149, Pigment Red 166, Pigment Red 177, Pigment Red 178, and Pigment Red 222; C.I. Pigment Orange 31, and Pigment Orange 43; C.I. Pigment Yellow 14, Pigment Yellow 17, Pigment Yellow 93, Pigment Yellow 94, and Pigment Yellow 138; and C.I. Pigment Green 7; and C.I. Pigment Blue 15:3, and Pigment Blue 60; and the like. These mixtures may also be employed. The average primary particle diameter varies depending on type, generally, however it is preferably between about 10 and about 200 nm.

The colorants may be added employing ant of several common methods, in which colorants are added during which polymer particles prepared by an emulsion polymerization method are coagulated by adding a coagulant and the polymer is tinted; during polymerizing of said monomers, a colorant is added and the resulting mixture is polymerized to form tinted particles; and the like. Further, when the colorant is added during polymer preparation, it is preferably subjected to surface treatment employing a coupling agent and the like, which is employed so that radical polymerization is not hindered.

Further, added as fixing property enhancing agents may be low molecular weight polypropylene (having a number average molecular weight of 1,500 to 9,000) or low molecular weight polyethylene.

Charge control agents may also be employed, which are known in the art, and can be dispersed into water. Specifically listed are Nigrosine based dyes, metal salts of naphthenic acid or higher fatty acids, alkoxylated amines, quaternary ammonium salts, azo based metal complexes, salicylic acid metal salts or metal complexes thereof, and such.

Further, these charge control agents and fixing property enhancing agents are preferably in a dispersed state, and the number average primary particle diameter is adjusted from about 10 to about 500 nm.

In a suspension polymerization method in which a composition, prepared by dispersing or dissolving toner constitution components such as a colorant and the like in polymerizable monomers, is suspended in a water based medium, and then undergoes polymerization to obtain the toner, the shape of toner particles may be controlled by controlling the flow of the medium in a reaction vessel in which the reaction is carried out. Namely, when many toner particles having a shape coefficient of at least 1.2 are formed, the flow in the reaction vessel is regulated to a turbulent one; polymerization proceeds; and when oil droplets suspended in the water based medium are gradually polymerized and oil droplets become soft particles, particle union is accelerated due to collisions of particles resulting in particles which are not stable in shape. Further, when spherical toner particles having a shape coefficient of not more than 1.2 are formed, the flow of the medium in said reaction vessel is regulated to a laminar flow to result in spherical particles upon minimal collisions between particles. Employing such methods, it is possible to control the toner shape distribution within the range specified by the present invention.

The developing apparatus to be used in the image forming method of the invention is described below. The developing apparatus to be used in the invention has a developer carrying member, a toner layer regulation member, and a developer supply assisting means and a developer carrying member and the developer layer regulation member and the developer carrying member are respectively contacted with together. In the developing system, the latent image is developed by supplying the thin layer of the non-magnetic developer formed by the apparatus.

The developer carrying member supplies the non-magnetic single-component developer onto the electrostatic latent image forming member, which is preferably elastic for obtaining a sufficient developing area by the elasticity in the state of contacted with the electrostatic latent image forming member.

In the invention, a roller of urethane rubber or silicone rubber, and a nickel endless belt-shaped member including a sponge roller therein are usable for the developer carrying member.

The developer layer regulation member has a function of uniformly providing the developer on the developer carrying member and giving frictional charge. An elastic material such as urethane rubber or a metal plate is used as the developer layer regulation means. Such the member is contacted to the developer carrying member to form the thin layer of the developer on the developer carrying member. The thin layer of the developer is a layer formed by piling 10 layers at the maximum, preferably not more than 5 layers, of the developer particles. The developer layer regulation member is preferably contacted with the developer carrying member at a pressure of from 0.1 N/cm to 5.0 N/cm, and more preferably from 0.2 to 4.0 N/cm. When the pressure is less than 0.1 N/cm, the transportation of the developer becomes non-uniform so that non-uniformity of the image and a problem of occurrence of white line defect on the image tend to be caused. The developer carrying member preferably has a diameter of from 10 to 50 mm.

The developer supply assisting member is a unit for stably supplying the developer to the developer carrying member. As such the supply assisting member, a water wheel-shaped roller having a stirring wing or a sponge roller can be used. The supply assisting member preferably has a diameter of from 0.2 to 1.5 times of the diameter of the developer carrying member. When the diameter is too small, the supply of the developer becomes insufficient and the diameter excessively large causes excessive supply of the developer. In both of the cases, the supply of the developer becomes instable and line-shaped image defects tend to be caused.

The electrostatic latent image carrying member is typically an electrophotographic photoreceptor. In concrete, an inorganic photoreceptor such as a selenium, arsenic-selenium and amorphous silicon photoreceptor and an organic photoreceptor can be cited. The organic photoreceptor is particularly preferred and that having a multi-layered structure including a charge transfer layer and a charge generation layer is preferable.

FIG. 1 shows a schematic cross section of an example of the developing apparatus for the image forming method of the invention.

In FIG. 1, a non-magnetic single-component developer 16 contained in a developer tank 17 is coercively conveyed and supplied onto a sponge roller 14 as the developer supply assisting member by a stirring wing 15 as the developer supply assisting member. The developer thus supplied on the sponge roller 14 is conveyed onto a developer carrying member 12 as the developer carrying member by rotation of the sponge roller in the arrow direction. The developer is electrostatically and physically absorbed on the surface of the developer carrying member by the friction with the developer carrying member 12. The developer thus absorbed on the developer carrying member 12 is formed into a uniform thin layer and frictionally electrified by rotation of the developer carrying member 12 in the arrow direction and a steel elastic blade 13 as the developer layer regulation member. After that, the developer thin layer formed on the developer carrying member 12 is contacted or neared to the surface of an electrophotographic photoreceptor drum 11 as the electrostatic latent image carrying member for developing the latent image.

As a fixing method preferably applied in the invention, a contact heating method can be cited. The contact heating method includes a heat-pressing fixing method, particularly the heat-pressing fixing method using a heating roller or that using a rotatable pressing member including a heater fixed therein.

In the heating roller fixing method, the apparatus is frequently composed of an upper roller composed of a metal cylinder of iron or aluminum covered with tetrafluoroethylene or poly(tetrafluoroethylene-perfluoroalkoxy vinyl ether) which has a heat source therein and a lower roller composed of a material such as silicone rubber. The typical example of the heat source is a line-shaped heater capable of heating the upper roller by a surface temperature of from 120 to 200° C. In the fixing portion, pressure is applied between the upper and the lower rollers to form a nip by deformation of the lower roller. The width of the nip is from 1 to 10 mm and preferably from 1.5 to 7 mm. The line speed of fixation is preferably from 40 to 600 mm/sec. When the nip is too narrow, heat cannot be uniformly applied to the developer so as to cause non-uniform fixing. Besides, the excessively wide nip accelerates the fusion of the developer and causes a problem of excessive occurrence of off-set.

A fixing apparatus cleaning means may be provided. As such the method, a method by supplying silicone oil to the upper roller of the film or that for cleaning by a pat, roller or web impregnated with silicone oil are applicable.

The method for fixing by a rotating pressing member including a heating member fixed therein is described bellow.

In such the fixing system, the fixation is carried out by pressing and heating by the fixedly provided heating member and the pressing member faced and pressed to the heating member by which the recording material is contacted to the heating member through film.

In the heat-pressing fixing apparatus, the heating member has a line-shaped heater provided in the direction crossing at a right angle to the conveying direction of the recording material, and the thermal capacity thereof is smaller than that of a usual heating roller, and the highest temperature of the heater is within the range of from 100 to 300° C.

The heat-pressing fixation is a fixing method by pressing the non-fixed developer image to the heating source such as a usually applied method in which a recording material carrying the non-fixed developer image is passed between a heating member and a pressing member. The fixing speed can be raised by such the method since heat can be rapidly applied. However, the fixing temperature is difficultly controlled and the developer off-set tends to be caused by developer remaining at the portion to be directly touched to the non-fixed developer such as the surface of the heating member and a problem of winding the recording material on the fixing roller tends to be caused.

EXAMPLES

The following examples will further illustrate the invention. However, the embodiment of the invention is not limited to the examples.

Example 1

Preparation of Colored Particle C1

(1) Preparation of Latex 1HML

1) Preparation of Core Particle (The First Step of Polymerization): Preparation of Latex 1H Into a 5,000 ml separable flask, to which a stirring device, a thermal sensor, a cooling pipe and a nitrogen gas introducing device are attached, a surfactant solution (aqueous medium) composed of 3,010 g of deionized water and 7.08 g of an anionic surfactant, sodium lauryl sulfate, dissolved in the deionized water was charged and heated by 80° C. while stirring at a stirring rate of 230 rpm.

To the surfactant solution, an initiator solution composed of 400 g of deionized water and 9.2 g of a polymerization initiator (potassium persulfate: KPS) dissolved therein was added and then the temperature was adjusted to 75° C. After that, a mixture of monomers composed of 74.7 g of styrene, 22.0 g of n-butyl acrylate, 0.88 g of acrylic acid and 0.50 g of 2-hydroxyethylacrylate was dropped spending 1 hour. The system was heated and stirred at 75° C. for 2 hours to perform the polymerization (the first step polymerization) to form latex (dispersion of resin particles composed of high molecular weight resin). The latex was referred to as Latex 1H.

2) Formation of Intermediate Layer (Second Step of Polymerization): Preparation of Latex 1HM A monomer solution was prepared by adding 98.0 g of compound represented by the following Formula, to a monomer mixture liquid composed of 104.9 g of styrene, 30.2 g of n-butyl acrylate, 1.24 g of acrylic acid, 0.70 g of 2-hydroxyethylacrylate and 5.6 g of n-octyl-3-mercaptopropionic acid ester at 90° C. in a flask to which a stirring device was attached.

Chemical Formula

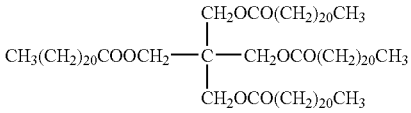

On the other hand, a surfactant solution composed of 2,700 ml of deionized water and, dissolved therein, 1.6 g of an anionic surfactant, sodium lauryl sulfate, was heated up to 98° C. and 28 g in terms of solid ingredient of Latex 1H which is a dispersion of the core particles was added to the surfactant solution. Then the above prepared monomer solution was mixed and dispersed for 8 hours in the above resulted liquid by a mechanical dispersing apparatus having a circulation pass CLEARMIX manufactured by M Technique Co., Ltd., to prepare a dispersion (emulsion) containing emulsified particles (oil droplets).

After that, an initiator liquid composed of 240 ml of deionized water and 5.1 g of the polymerization initiator (KPS) dissolved therein, and 750 ml of deionized water was added to the dispersion liquid (emulsion), the system was heated and stirred for 12 hours at 98° C. to perform polymerization (second step polymerization). Thus latex was obtained which was referred to as Latex 1HM, which is a dispersion liquid of composite resin particles having a structure that the surface of resin particles composed of the high molecular weight resin is covered with a resin having medium molecular weight.

3) Preparation of Outer Layer (The Third Step of Polymerization): Preparation of Latex 1HML To thus obtained Latex 6HM, an initiator solution composed of 200 ml of deionized water and 7.4 g of the polymerization initiator (KPS) dissolved therein was added and then a monomer mixture liquid composed of 311 g of styrene, 85 g of n-butyl acrylate, 3.62 g of acrylic acid, 2.04 g of 2-hydroxyethylacrylate and 10.4 g of n-octyl-3-mercaptopropionic acid ester was dropped to the latex spending for 1 hour at a temperature condition of 80° C. After completion of the dropping, the resulted liquid was heated and stirred for 1 hour for polymerization (third step polymerization), and then cooled by 28° C. to obtain latex. Thus obtained latex was referred to as Latex 1HML.

(2) Preparation of Colorant Dispersion 1

In 1,600 ml of deionized water, 90 g of the anionic surfactant was dissolved by stirring. To the solution, 400.0 g of C.I. Pigment Blue 15:3 was gradually added while stirring, and then dispersed by the stirring apparatus CLEARMIX manufactured by M Technique Co., Ltd. so as to obtain the colorant particles having particle diameter of less than 200 nm, and dispersion of a colorant was obtained. The dispersion was referred to as Colorant Dispersion 1.

(3) (Coagulation·Fusion) Preparation of Coagulated Particles

Into a reaction vessel (four-mouth flask) to which a thermal sensor, a cooling tube, a nitrogen gas introducing device and a stirring device were attached, 200 g in terms of solid ingredient of Latex 1HML, 3,000 g of deionized water and 33 g of Colorant Dispersion 1 were charged. The inner temperature of the vessel was adjusted to 30° C. and then the pH value of the liquid was adjusted to 8-11.0 by adding a 5 mol/L aqueous solution of sodium hydroxide. After that, a solution composed of 20 ml of deionized water and, dissolved therein, 20 g of magnesium chloride hexahydrate was dropped to the above liquid spending for 10 minutes at 30° C. The liquid was stood for 3 minutes and then heated up to 75° C. spending 60 minutes.

Under such the conditions, the diameter of the associated particle was measured by Coulter Counter MS-II, and an aqueous solution composed of 60 ml of deionized water and, dissolved therein, 29 g of sodium succinate was added at a time when the number average diameter of the particles was attained at 6-7 μm to stop the growing the particles. Moreover, the fusion of the particles was continued as a ripening treatment by heating and stirring for 6 hours at 90° C. After that temperature was cooled down to 30° C., pH was adjusted to 2.0 with hydrochloric acid, then stirring was terminated. Thus formed particles of salted out, coagulated and fused were filtrated and washed repeatedly with deionized water at 45° C. Colored particles C1 was obtained by drying warm air at 40° C.

Preparation of Colored Particle C2

(1) Preparation of Latex 2HML

1) Preparation of Core Particle (The First Step of Polymerization): Preparation of Latex 2H In the preparation process of Latex 1H, a mixture of monomers composed of 75.3 g of styrene, 16.7 g of n-butyl acrylate, 2.47 g of acrylic acid and 1.59 g of 2-hydroxyethylacrylate was employed to obtain latex. The latex was referred to as Latex 1H.

2) Formation of Intermediate Layer (Second Step of Polymerization): Preparation of Latex 2HM In the preparation process of Latex 1HM, Latex 2H was employed in place of Latex 1H, and a monomer mixture composed of 101.2 g of styrene, 30.1 g of n-butyl acrylate, 3.52 g of acrylic acid, and 2.27 g of 2-hydroxyethylacrylate was employed for the polymerization. Thus latex referred to as Latex 2HM.

3) Preparation of Outer Layer (The Third Step of Polymerization): Preparation of Latex 2HML In the preparation process of Latex 1HML, a monomer mixture liquid composed of 299 g of styrene, 87 g of n-butyl acrylate, 10.3 q of acrylic acid, and 6.66 g of 2-hydroxyethylacrylate was employed for the polymerization to obtain latex. Thus obtained latex was referred to as Latex 2HML.

Colored Particle C2 was obtained by preparation of associated particles employing Latex 2HML in place of Latex 1HML in the preparation process of Colored Particle C1.

Preparation of Colored Particle C3

(1) Preparation of Latex 3HML

1) Preparation of Core Particle (The First Step of Polymerization): Preparation of Latex 3H Latex was prepared employing a mixture of monomers composed of 76.2 g of styrene, 17.1 g of n-butyl acrylate, 1.47 g of methacrylic acid and 1.56 g of 2-hydroxyethylmethacrylate in the preparation process of Latex 1H. The latex was referred to as Latex 3H.

2) Formation of Intermediate Layer (Second Step of Polymerization): Preparation of Latex 3HM In the preparation process of Latex 1HM, Latex 3H was employed in place of Latex 1H, and a monomer mixture composed of 103.4 g of styrene, 29.6 g of n-butyl acrylate, 2.10 g of methacrylic acid, and 2.27 g of 2-hydroxyethylmethacrylate was employed for the polymerization. Thus latex referred to as Latex 3HM.

3) Preparation of Outer Layer (The third Step of Polymerization): Preparation of Latex 3HML In the preparation process of Latex 1HML, a monomer mixture liquid composed of 302 g of styrene, 88 g of n-butyl acrylate, 6.19 g of methacrylic acid, and 6.55 g of 2-hydroxyethylmethacrylate was employed for the polymerization to obtain latex. Thus obtained latex was referred to as Latex 3HML.

Colored Particle C3 was obtained by preparation of associated particles employing Latex 3HML in place of Latex 1HML in the preparation process of Colored Particle C1.

Preparation of Colored Particle C4

(1) Preparation of Latex 4HML

1) Preparation of Core Particle (The First Step of Polymerization): Preparation of Latex 4H A latex was prepared employing a mixture of monomers composed of 70.8 g of styrene, 17.6 g of n-butyl acrylate, 3.70 g of methacrylic acid and 4.19 g of 2-hydroxyethylmethacrylate in the preparation process of Latex 1H. The latex was referred to as Latex 4H.

2) Formation of Intermediate Layer (Second Step of Polymerization): Preparation of Latex 4HM In the preparation process of Latex 1HM, Latex 4H was employed in place of Latex 1H, and a monomer mixture composed of 94.3 g of styrene, 31.5 g of n-butyl acrylate, 5.25 g of methacrylic acid, and 5.96 g of 2-hydroxyethylmethacrylate was employed for the polymerization. Thus latex referred to as Latex 4HM.

3) Preparation of Outer Layer (The Third Step of Polymerization): Preparation of Latex 4HML In the preparation process of Latex 1HML, a monomer mixture liquid composed of 283 g of styrene, 87 g of n-butyl acrylate, 15.5 g of methacrylic acid, and 17.5 g of 2-hydroxyethylmethacrylate was employed for the polymerization to obtain latex. Thus obtained latex was referred to as Latex 4HML.

Colored Particle C4 was obtained by preparation of associated particles employing Latex 4HML in place of Latex 1HML in the preparation process of Colored Particle C1.

Preparation of Colored Particle C5

(1) Preparation of Latex 5HML

1) Preparation of Core Particle (The First Step of Polymerization): Preparation of Latex 5H A latex was prepared employing a mixture of monomers composed of 80.3 g of styrene, 15.8 g of n-butyl acrylate, and 0.25 g of acrylic acid in the preparation process of Latex 1H. The latex was referred to as Latex 5H.

2) Formation of Intermediate Layer (Second Step of Polymerization): Preparation of Latex 5HM In the preparation process of Latex 1HM, Latex 5H was employed in place of Latex 1H, and a monomer mixture composed of 107 g of styrene, 29.6 g of n-butyl acrylate, and 0.352 g of acrylic acid was employed for the polymerization. Thus latex referred to as Latex 5HM.

3) Preparation of Outer Layer (The Third Step of Polymerization): Preparation of Latex 5HML In the preparation process of Latex 1HML, a monomer mixture liquid composed of 315 g of styrene, 87 g of n-butyl acrylate, and 1.04 g of acrylic acid was employed for the polymerization to obtain latex. Thus obtained latex was referred to as Latex 5HML.

Colored Particle C5 was obtained by preparation of associated particles employing Latex 5HML in place of Latex 1HML in the preparation process of Colored Particle C1.

Preparation of Colored Particle C6

(1) Preparation of Latex 6HML

1) Preparation of Core Particle (The First Step of Polymerization): Preparation of Latex 6H A latex was prepared employing a mixture of monomers composed of 72.0 g of styrene, 18.2 g of n-butyl acrylate, 4.95 g of acrylic acid and 1.20 g of 2-hydroxyethylmethacrylate in the preparation process of Latex 1H. The latex was referred to as Latex 6H.

2) Formation of Intermediate Layer (Second Step of Polymerization): Preparation of Latex 6HM In the preparation process of Latex 1HM, Latex 6H was employed in place of Latex 1H, and a monomer mixture composed of 96.1 g of styrene, 32.2 g of n-butyl acrylate, 7.05 g of acrylic acid and 1.70 g of 2-hydroxyethylmethacrylate was employed for the polymerization. Thus latex referred to as Latex 6HM.

3) Preparation of Outer Layer (The Third Step of Polymerization): Preparation of Latex 6HML In the preparation process of Latex 1HML, a monomer mixture liquid composed of 285 g of styrene, 92 g of n-butyl acrylate, 20.7 g of acrylic acid and 5.00 g of 2-hydroxyethylmethacrylate was employed for the polymerization to obtain latex. Thus obtained latex was referred to as Latex 6HML.

Colored Particle C6 was obtained by preparation of associated particles employing Latex 6HML in place of Latex 1HML in the preparation process of Colored Particle C1.

Preparation of Colored Particle C7

(1) Preparation of Latex 7HML

1) Preparation of Core Particle (The First Step of Polymerization): Preparation of Latex 7H A latex was prepared employing a mixture of monomers composed of 79.7 g of styrene, 15.6 g of n-butyl acrylate, 0.44 g of methacrylic acid and 0.64 g of 2-hydroxyethylmethacrylate in the preparation process of Latex 1H. The latex was referred to as Latex 7H.

2) Formation of Intermediate Layer (Second Step of Polymerization): Preparation of Latex 7HM In the preparation process of Latex 1HM, Latex 7H was employed in place of Latex 1H, and a monomer mixture composed of 106 g of styrene, 29.3 g of n-butyl acrylate, 0.63 g of methacrylic acid and 0.92 g of 2-hydroxyethylmethacrylate was employed for the polymerization. Thus latex referred to as Latex 7HM.

3) Preparation of Outer Layer (The Third Step of Polymerization): Preparation of Latex 7HML In the preparation process of Latex 1HML, a monomer mixture liquid composed of 312 g of styrene, 86 g of n-butyl acrylate, 1.86 g of methacrylic acid and 2.69 g of 2-hydroxyethylmethacrylate was employed for the polymerization to obtain latex. Thus obtained latex was referred to as Latex 7HML.

Colored Particle C7 was obtained by preparation of associated particles employing Latex 7HML in place of Latex 1HML in the preparation process of Colored Particle C1.

Preparation of Colored Particle C8

(1) Preparation of Latex 8HML

1) Preparation of Core Particle (The First Step of Polymerization): Preparation of Latex 87H A latex was prepared employing a mixture of monomers composed of 58.7 g of styrene, 16.9 g of n-butyl acrylate, 7.40 g of methacrylic acid and 19.1 g of 2-hydroxyethylmethacrylate in the preparation process of Latex 1H. The latex was referred to as Latex 8H.

2) Formation of Intermediate Layer (Second Step of Polymerization): Preparation of Latex 8HM In the preparation process of Latex 1HM, Latex 8H was employed in place of Latex 1H, and a monomer mixture composed of 76.3 g of styrene, 31.2 g of n-butyl acrylate, 10.5 g of methacrylic acid and 19.1 g of 2-hydroxyethylmethacrylate was employed for the polymerization. Thus latex referred to as Latex 8HM.

3) Preparation of Outer Layer (The third Step of Polymerization): Preparation of Latex 8HML In the preparation process of Latex 1HML, a monomer mixture liquid composed of 224 g of styrene, 91.5 g of n-butyl acrylate, 30.9 g of methacrylic acid and 56.1 g of 2-hydroxyethylmethacrylate was employed for the polymerization to obtain latex. Thus obtained latex was referred to as Latex 8HML.

Colored Particle C7 was obtained by preparation of associated particles employing Latex 7HML in place of Latex 1HML in the preparation process of Colored Particle C1.

(Acid Value and Hydroxyl Group Value of Binder Resin)

The acid value and the hydroxyl group value of the binder resin were measured in accordance with JIS K-0070. Provided that tetrahydrofuran was used as the solvent because the resin cannot be solved by the mixture of diethyl ether and ethanol designated in JIS. A potentiometric titration method was used since the end point was made unclear sometimes by coloring of the solution in the neutralization titration using an indicator. Measured results are shown in Table 1.

TABLE 1

| Binder Resin | Acid value (mgKOH/g) | Hydroxyl group Value (mgKOH/g) | Hydroxyl group value/Acid value | Remarks |
|---|---|---|---|---|
| Latex 1 HML | 7 | 2.45 | 0.35 | Inventive |
| Latex 2 HML | 20 | 8 | 0.4 | Inventive |
| Latex 3 HML | 10 | 7 | 0.7 | Inventive |
| Latex 4 HML | 25 | 18.75 | 0.75 | Inventive |
| Latex 5 HML | 2 | 0.4 | 0.2 | Comparative |
| Latex 6 HML | 40 | 6 | 0.15 | Comparative |
| Latex 7 HML | 3 | 2.88 | 0.96 | Comparative |
| Latex 8 HML | 50 | 60 | 1.2 | Comparative |

<<Preparation of Developers C1 to C8>>

To each of the above prepared Colored Particles C1 to C8, 1.0% by weight of hydrophobic silica TG-811F, manufactured by Cabosil Co., Ltd., 1.5% by weight of strontium titanate particles and 1.0% by weight of NX90, manufactured by Nihon Aerosil Co., Ltd., were added and mixed by Henschel mixer, manufactured by Mitsui Mining Co., Ltd. Then coarse particles were removed from the resultant mixture by a sieve having an opening size of 45 μm. Thus Developers C1 to C8 ere prepared.

(Softening Point)

The softening point of the developer is a value measured by a flow tester. Concretely, Flow Tester CFT-500, manufactured by Shimadzu Seisakusho Co., Ltd., was used under the conditions of a fine hole diameter of the die of 1 mm and a length of 1 mm, a load of $1.96\times10^6$ Pa and a temperature rising rate of 6° C./min. One cubic centimeter of sample was melted and flown out and the softening point was determined by the temperature corresponding to ½ point between the temperature at the beginning of flowing and that at the ending of flowing.

Evaluation

The fixing ability and the durability of the developer were evaluated by using a color laser printer MAGICOLOR 2300DL, manufactured by Konica Minolta Business Technologies Co., Ltd., which separately had the transferring mechanism and the fixing mechanism.

(Fixing Ability; Non Off-Set Temperature Range)

The test machine was modified so that the fixing temperature of the fixing apparatus can be optionally varied. A solid image formed by three colors (Y, M and C) in a total amount of 15 g/m$^2$ was printed for determined the lower limit of temperature at which the off-set is not caused. For determining the upper limit temperature at which the off-set is not caused, mono-color gradation images of each color developers in an amount of 0 to 5.0 g/m$^2$ were printed. The evaluation was carried out according to the range of the temperature in which the low temperature off-set and high temperature off-set are not caused on any of the images (non off-set temperature range). Standard CF paper for CF900 having a weight of 80 g/m$^2$ was used for the test. Samples on which the off-set was slightly observed were judged as inferior.

A: The non off-set temperature range was not less than 40° C.

B: The non off-set temperature range was not less than 30° C. and less than 40° C.

C: The non off-set temperature range was less than 30° C.

(Low Temperature Fixing Ability; Folding Test)

The image formed and fixed at 130° C. by the above testing condition for evaluating the non off-set temperature range was folded at the middle portion of the image and peeling off of the image was visually observed.

A: No peeling off was observed on the image.

B: The peeling off was caused some degree but acceptable for practical use.

C: The peeling off was considerably caused, some problems were caused for practical use.

(Durability; Mechanical Stability)

The durability test was carried out by 2,000 times of printing operation using white paper without image formation, and then the tested developer was take out and observed by a reflection microscope at a magnitude of 1,000 times and for 5 observing fields and number of crushed particles per 500 particles of the developer was counted. The evaluation norms were as follows.

A: No crushed particle was observed, acceptable for practical use.

B: One to 9 crushed particles were observed but acceptable for practical use.

C: Ten or more crushed particles were observed, some problems were caused for practical use.

TABLE 2

| Developer | Binder resin | Softening point (° C.) | Fixing ability | Low temperature fixing ability | Durability | Remarks |
|---|---|---|---|---|---|---|
| C1 | Latex 1 HLM | 110 | A | A | A | Inv. |
| C2 | Latex 2 HML | 115 | A | A | A | Inv. |
| C3 | Latex 3 HML | 113 | A | A | A | Inv. |
| C4 | Latex 4 HML | 116 | A | A | A | Inv. |
| C5 | Latex 5 HML | 110 | C | B | C | Comp. |
| C6 | Latex 6 HML | 117 | B | C | B | Comp. |
| C7 | Latex 7 HML | 113 | C | C | C | Comp. |
| C8 | Latex 8 HML | 120 | A | C | A | Comp. |

Inv.: Inventive,
Comp.: Comparative

It is understood from Table 2 that Developers C1 to C4 using the resin according to the invention are superior to the comparative Develpers C5 to C8 in the all evaluation items of the fixing ability, low temperature fixing ability and durability.

The invention claimed is:

1. An image forming method comprising steps of;

forming an electrostatic latent image on an electrostatic latent image carrying member, developing the electrostatic latent image by a non-magnetic single-component developing system, in which a non-magnetic single-component developer is conveyed by a developer carrying member, and the developer carrying member is contacted with a developer layer regulation member for regulating an amount of the developer at the surface of the developer carrying member, wherein a binder resin of the developer comprises a vinyl polymer having an acid value of from 5 to 30 (mgKOH/g) and a ratio of hydroxyl group value/acid value is from 0.3 to 0.8, and the vinyl polymer is derived from a monomer having an acid group and a monomer having a hydroxyl group as polymerizable monomers to constitute the vinyl polymer.

2. The image forming method of claim 1 wherein a hydroxyl group value of the vinyl polymer is from 1.5 to 24 (mgKOH/g).

3. The image forming method of claim 1 wherein the vinyl polymer comprises a hydroxyl group and an acid group in a side chain.

4. The image forming method of claim 1 wherein the acid group is at least one of a carboxyl group, a sulfonic acid group and a phosphoric acid group.

5. The image forming method of claim 1 wherein the monomer having an acid group includes at least one of acrylic acid, methacrylic acid, maleic acid, itaconic acid, cinnamic acid, fumaric acid, monoalkyl maleate, monoalkyl itaconate, styrenesulfonic acid, allylsulfosuccinic acid, 2-acrylamide-2-methylpropanesulfonic acid, acidphosphoxyethyl methacrylate and 3-chloro-2-acidphophoxypropyl methacrylate.

6. The image forming method of claim 1, wherein the monomer having a hydroxyl group includes at least one of hydroxyalkyl acrylate and hydroxyalkyl methacrylate.

7. The image forming method of claim 1 wherein the monomer having a hydroxyl group includes at least of 2-hydroxyethyl acrylate, 2-hydroxyethyl methacrylate, 2-hydroxypropyl acrylate, 2-hydroxypropyl methacrylate, 2-hydroxybutyl acrylate, 2-hydroxybutyl methacrylate, 4-hydroxybutyl acrylate and 4-hydroxybutyl methacrylate.

8. The image forming method of claim 1 wherein the monomer having a hydroxyl group is vinyl ether having a hydroxyl group.

9. The image forming method of claim 8 wherein the monomer having a hydroxyl group includes at least one of 2-hydroxyethylvinylether, 4-hydroxybutylvinylether and 6-hydroxyhexyl vinylether.

10. The image forming method of claim 1 wherein a glass transition point of the binder resin is from 20 to 90° C.

11. The image forming method of claim 1 wherein a softening point of the binder resin is from 80 to 220° C.

12. The image forming method of claim 1 wherein the developer layer regulation member is contacted with the developer carrying member at a pressure of from 0.1 N/cm to 5.0 N/cm.

13. The image forming method of claim 12 wherein the developer layer regulation member is a urethane rubber or a metal plate.

14. The image forming method of claim 13 wherein the developer layer regulation member is a steel elastic blade.

15. The image forming method of claim 1 wherein the developer layer regulation member is contacted with the developer carrying member at a pressure of from 0.2 to 4.0 N/cm.

16. The image forming method of claim 1, wherein the developer is formed by coagulating a resin and a colorant in an aqueous medium.

* * * * *